US006443274B1

(12) United States Patent
Klamm

(10) Patent No.: US 6,443,274 B1
(45) Date of Patent: Sep. 3, 2002

(54) FOLDABLE WHEELED CARRYING BAG

(75) Inventor: Randy L. Klamm, Evergreen, CO (US)

(73) Assignee: The Coleman Company Inc., Wichita, KS (US)

( * ) Notice: Subject to any disclaimer, the term of this patent is extended or adjusted under 35 U.S.C. 154(b) by 0 days.

(21) Appl. No.: 09/733,619

(22) Filed: Dec. 8, 2000

(51) Int. Cl.[7] ..... A45C 5/00; A45C 7/00; A45C 13/36

(52) U.S. Cl. ..... 190/18 A; 190/107; 190/127

(58) Field of Search ..... 190/107, 105, 190/127, 115, 18 A; 383/121.1

(56) References Cited

U.S. PATENT DOCUMENTS 584,870 A * 6/1897 Giugliano ..... 190/107 X
2,728,426 A * 12/1955 Dobyns ..... 190/107
4,160,496 A * 7/1979 Knight ..... 190/107
4,588,056 A * 5/1986 Bernhaum ..... 190/107
4,953,673 A * 9/1990 Ambasz ..... 190/107 X
5,031,734 A * 7/1991 King ..... 190/122
5,103,945 A * 4/1992 Kaneko ..... 190/107
5,749,446 A * 5/1998 Hsieh ..... 190/107
6,227,339 B1 * 5/2001 Bogert ..... 190/107 X

* cited by examiner

*Primary Examiner*—Lee Young
*Assistant Examiner*—Tri M. Mai
(74) *Attorney, Agent, or Firm*—Leydig, Voit & Mayer, Ltd.

(57) ABSTRACT

A lightweight, wheeled bag that is foldable into a compact configuration. A back panel of the bag is semi-rigid, and supports a retractable handle and wheels. The wheeled bag includes side, front, bottom, and top panels that are made of a soft, lightweight material. In a stored configuration of the wheeled bag, the soft panels fold into a stacked, compact arrangement against the back panel. The wheeled bag includes a hinged, semi-rigid panel that aligns against one of the side panels when the wheeled bag is in the stored configuration. When the wheeled bag is folded outward to an expanded configuration, the hinged, semi-rigid panel folds against the inside surface of the bottom panel. The side panels preferably each include a reinforcement. The reinforcements and the hinged, semi-rigid panel support the bag in an expanded position.

38 Claims, 5 Drawing Sheets

FOLDABLE WHEELED CARRYING BAG

FIELD OF THE INVENTION

The present invention relates generally to luggage, and more particularly to luggage having wheels.

BACKGROUND OF THE INVENTION

Wheeled articles of luggage, such as carrying cases, have become quite popular, especially for use while traveling. The most popular type of wheeled carrying luggage includes wheels on a lower side and a retractable handle. The handle is extended and is used for towing of the case with the wheels engaged against the ground. Placing the weight of the luggage on the wheels permits a traveler to roll the luggage from one location to another, instead of having to carry the luggage, relieving the burden typically placed on the shoulders, back, and arms of the traveler.

Typically, wheeled carrying bags are made of rigid sidewalls and a heavy reinforcing bottom panel. The rigid construction of the sidewalls holds open the walls of the luggage, permitting easy packing of the inside compartments of the luggage. The rigid bottom panel and sidewalls stabilize the luggage during towing. In addition, the bottom panel often provides an attachment location and support for the wheels.

While the prior art wheeled carrying bags work for their intended purpose, a significant drawback to these prior art wheeled carrying bags is that, due to the materials used in the rigid frames of the bags, the bags tend to be relatively heavy. In addition, the rigid nature of the bags makes their storage difficult, because the hard-sided bags require as much storage space when they are empty as they do when they are full.

SUMMARY OF THE INVENTION

The present invention provides a lightweight, wheeled bag that is foldable into a compact configuration. A back panel of the bag is semi-rigid or stiff, and supports a retractable handle and wheels. The wheeled bag includes side, front, bottom, and top panels that are made of a soft, lightweight material. In a stored configuration of the wheeled bag, the soft panels fold into a stacked, compact arrangement against the back panel.

The wheeled bag includes a hinged, semi-rigid panel that aligns against one of the side panels when the wheeled bag is in the stored configuration. When the wheeled bag is folded outward to an expanded configuration, the hinged, semi-rigid panel folds against the inside surface of the bottom panel of the wheeled bag. The hinged semi-rigid panel provides support for the bottom of the wheeled bag when the wheeled bag is in the expanded configuration. This support permits the wheeled bag to rest on the bottom panel when the wheeled bag is in the expanded configuration. In addition, the support aids in holding the wheeled bag open when the wheeled bag is in the expanded configuration.

The side panels of the wheeled bag preferably each include a reinforcement, such as a metal stay contained within webbing. The reinforcements are arranged so that they do not impede folding of the side panels into the stored configuration. in addition, the reinforcements work together with the hinged, semi-rigid panel to help hold open the side, top and bottom panels when the wheeled bag is in the expanded configuration. This feature provides easy packing of the inside compartment, or compartments, of the wheeled bag.

Other advantages will become apparent from the following detailed description when taken in conjunction with the drawings, in which:

DETAILED DESCRIPTION

Figure 1:
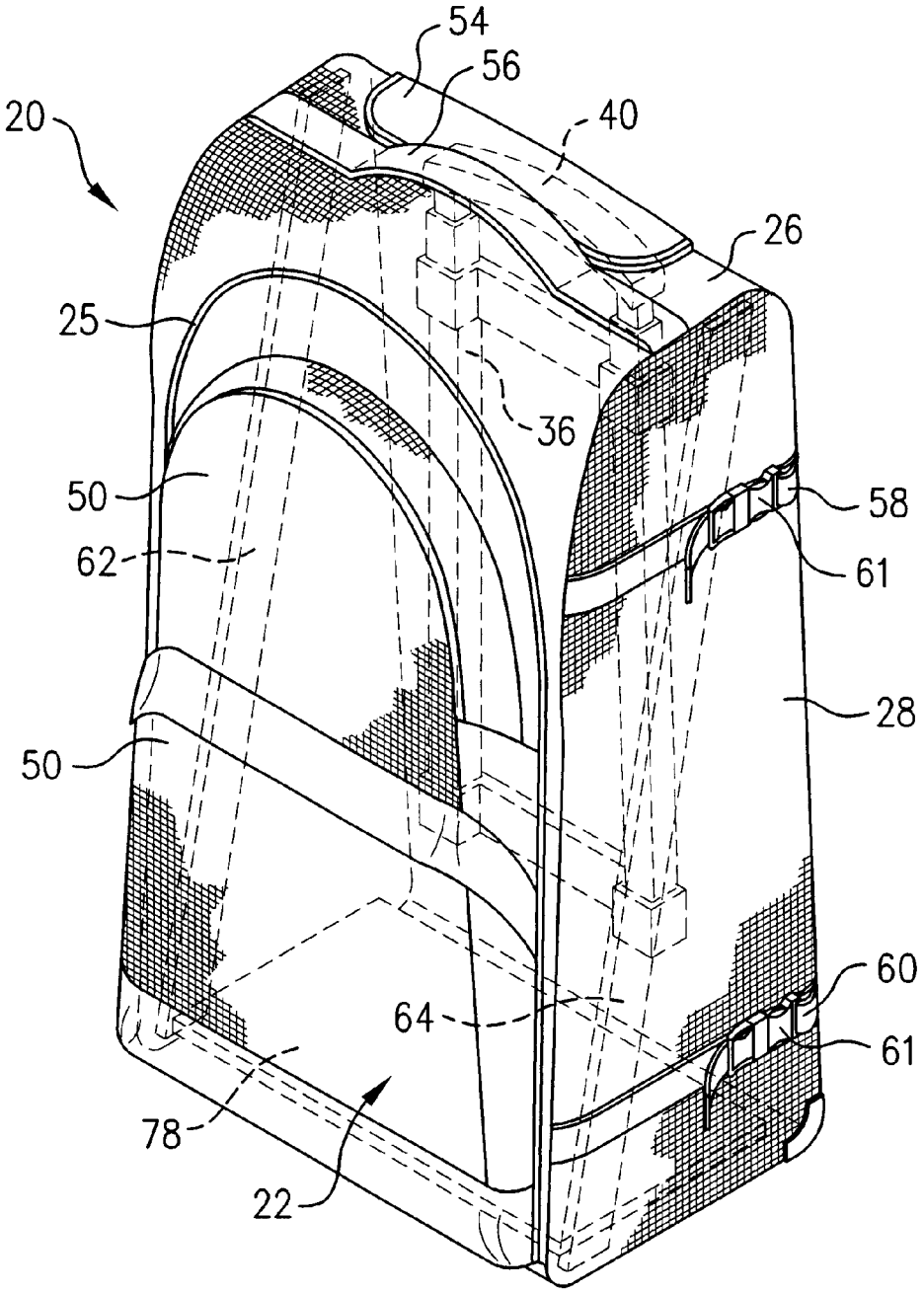
FIG. 1 is a top, right perspective view of a wheeled bag made in accordance with the present invention, shown in an expanded configuration.
Figure 6:
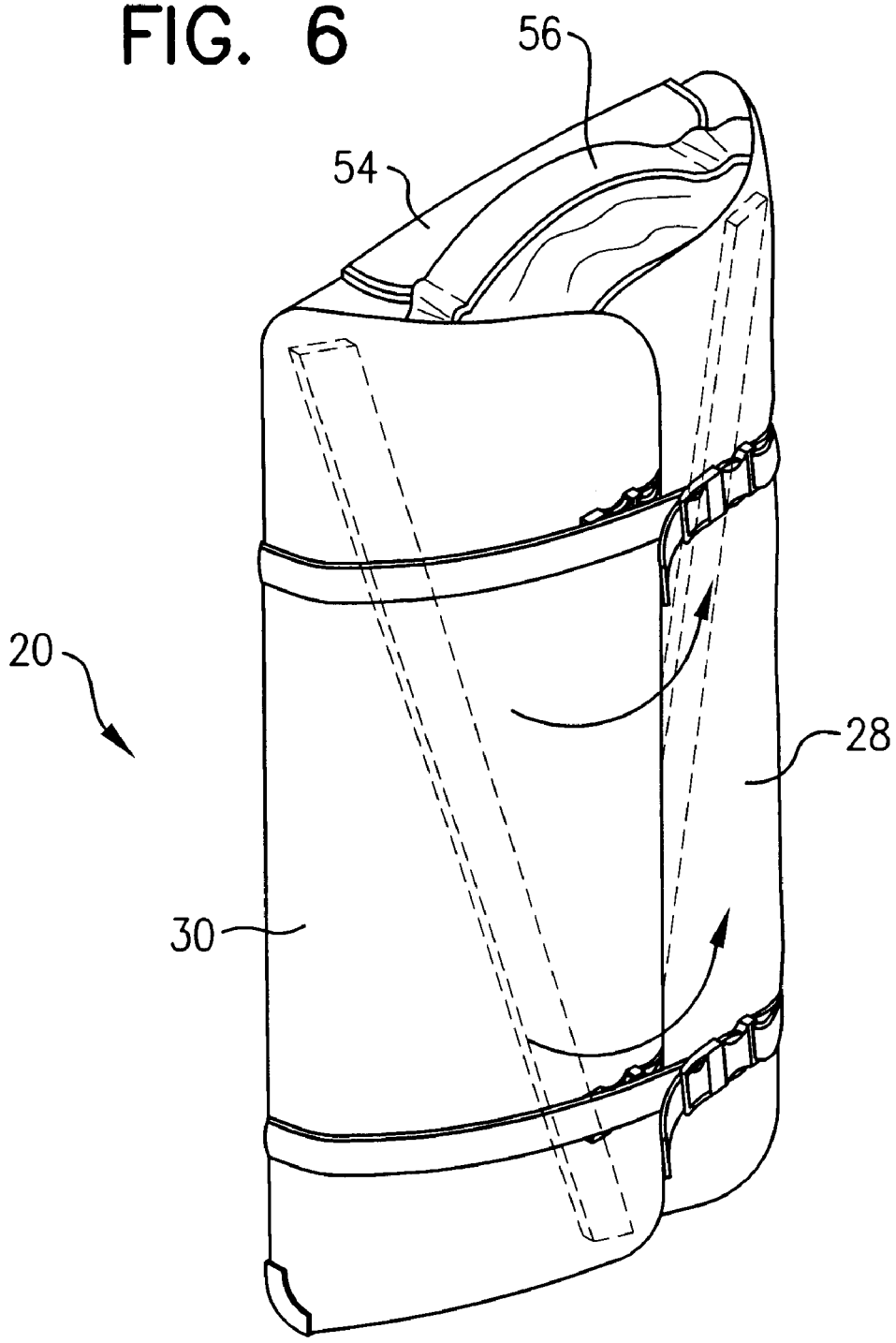
FIG. 6 shows the wheeled bag of FIG. 1 in a stored configuration.

Referring now to the drawing, in which like reference numerals represent like parts throughout the several views, FIG. 1 shows a wheeled bag 20 incorporating the present invention. Briefly described, the wheeled bag 20 includes a reinforcing structure that holds the bag open in an expanded configuration (FIG. 1). The reinforcing structure may be manipulated so that the wheeled bag 20 may be folded to a compact, storage configuration (FIG. 6).

Figure 2:
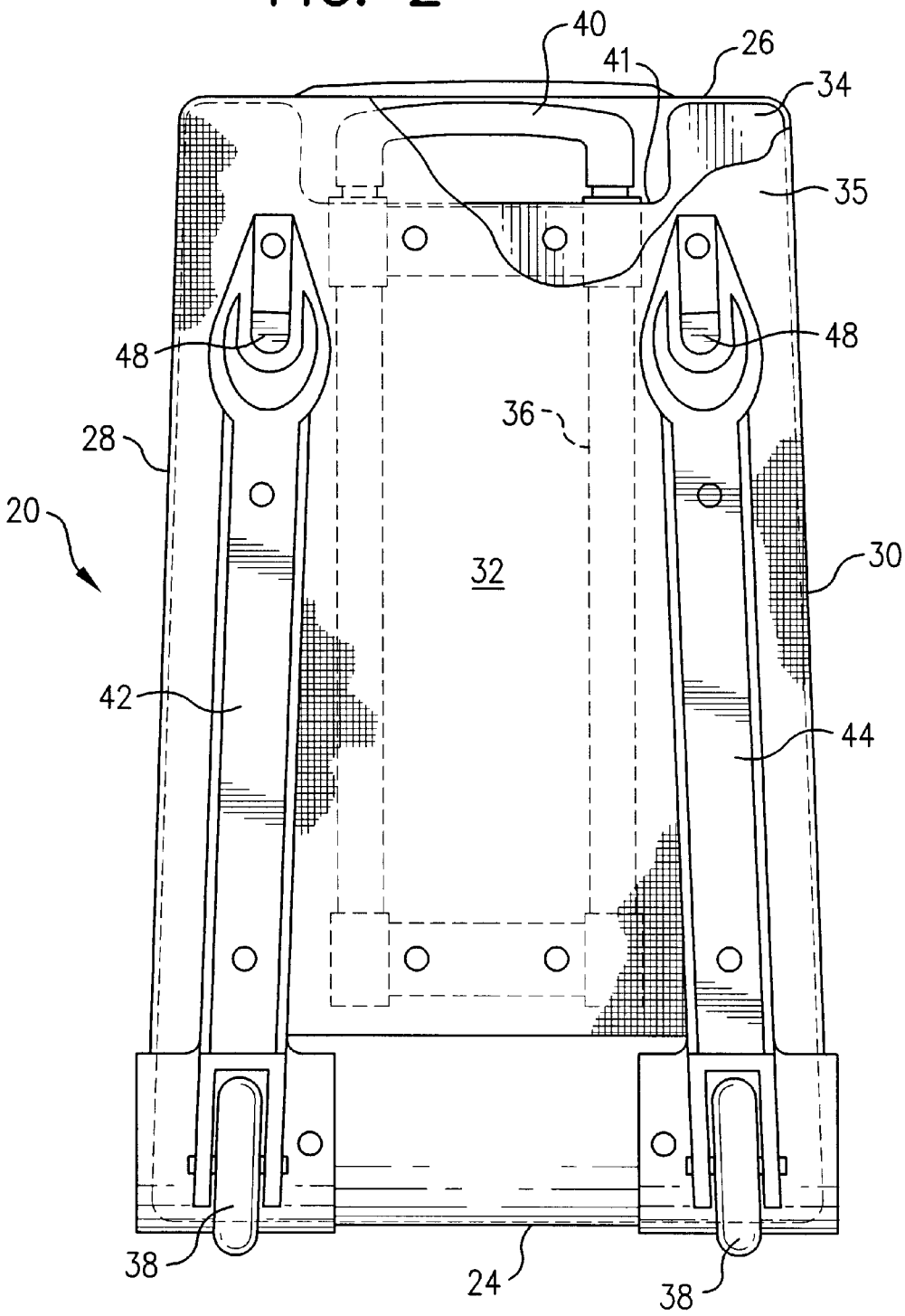
FIG. 2 is a rear view of the wheeled bag of FIG. 1.

The wheeled bag 20 includes a front panel 22 that is attached to a bottom panel 24 (FIG. 2), and is removably attached to a top panel 26 and right and left side panels 28, 30 by a zipper 25. As is further described below, the front panel 22, the top panel 26, the bottom panel 24, and the right and left panels 28, 30 are preferably formed of a soft, lightweight material, such as a fabric (e.g., canvas, nylon, or the like). The top panel 26, the bottom panel 24, and the right and left panels 28, 30 are attached to a back panel 32 (FIG. 2). The back panel 3 is preferably formed of a semi-rigid material, such as plastic, pressboard, cardboard, or the like.

As can be seen in FIG. 2, the back panel 32 includes a semi-rigid structure 34, onto which is attached a handle receptacle 36 and wheels 38. The semi-rigid structure 34 of the back panel 32 is preferably formed of a semi-rigid material, such as plastic, cardboard, pressboard, or the like. However, as described below, the semi-rigid structure may alternatively be formed of a rigid material. In the embodiment shown in the drawings, the semi-rigid structure 34 is encased in a fabric. If desired, padding (not shown) may be provided between the fabric 35 and the outside of the semi-rigid structure 34 to provide comfort for a user, or on the inside to protect items within the wheeled bag 20. The semi-rigid structure 34 extends the length and width of the back panel 32.

The handle receptacle 36 is configured to receive an extendible handle 40, which may be extended and used to pull or guide the wheeled bag 20 such as is known in the art.

The handle receptacle 36 is attached to the inside of the semi-rigid structure 34 by rivets, glue, screws, or another suitable attachment. A cutout 41 at the top, center of the semi-rigid structure 34 permits easy access to the extendible handle 40.

A pair of skid bars 42, 44 extend along the back side of the back panel 32. The skid bars 42, 44 may be used to drag the wheeled bag 20 over obstacles, such as stairs or the like. The skid bars 42, 44 are preferably attached to the semi-rigid structure 34 in a suitable manner, e.g., using glue, rivets, screws, or other conventional fasteners. Alternatively, the semi-rigid structure may be formed integrally with the skid bars 42, 44. This alternate configuration may require that the fabric 35 not extend over the entire surface of the back panel.

The wheels 38 are attached to lower ends of the skid bars 42, 44. The wheels 38 are configured and arranged so that the wheels come into contact with the ground when the wheeled bag 20 is placed on the ground. Feet 48 are included on the opposite ends of the skid bars so that the wheeled bag may be laid on its back and supported by the wheels 38 and the feet.

Returning now to FIG. 1, the front panel 22 may include one or more pouches 50 (two are shown in the embodiment in the drawings) on its front side for storage of quickly-accessible items. Additional pouches, straps, or containers may be provided at the different locations on the wheeled bag 20 so that a user may attach or store other items (e.g., additional baggage, a laptop computer, or a cup) on the outside of the wheeled bag 20.

Figure 3:
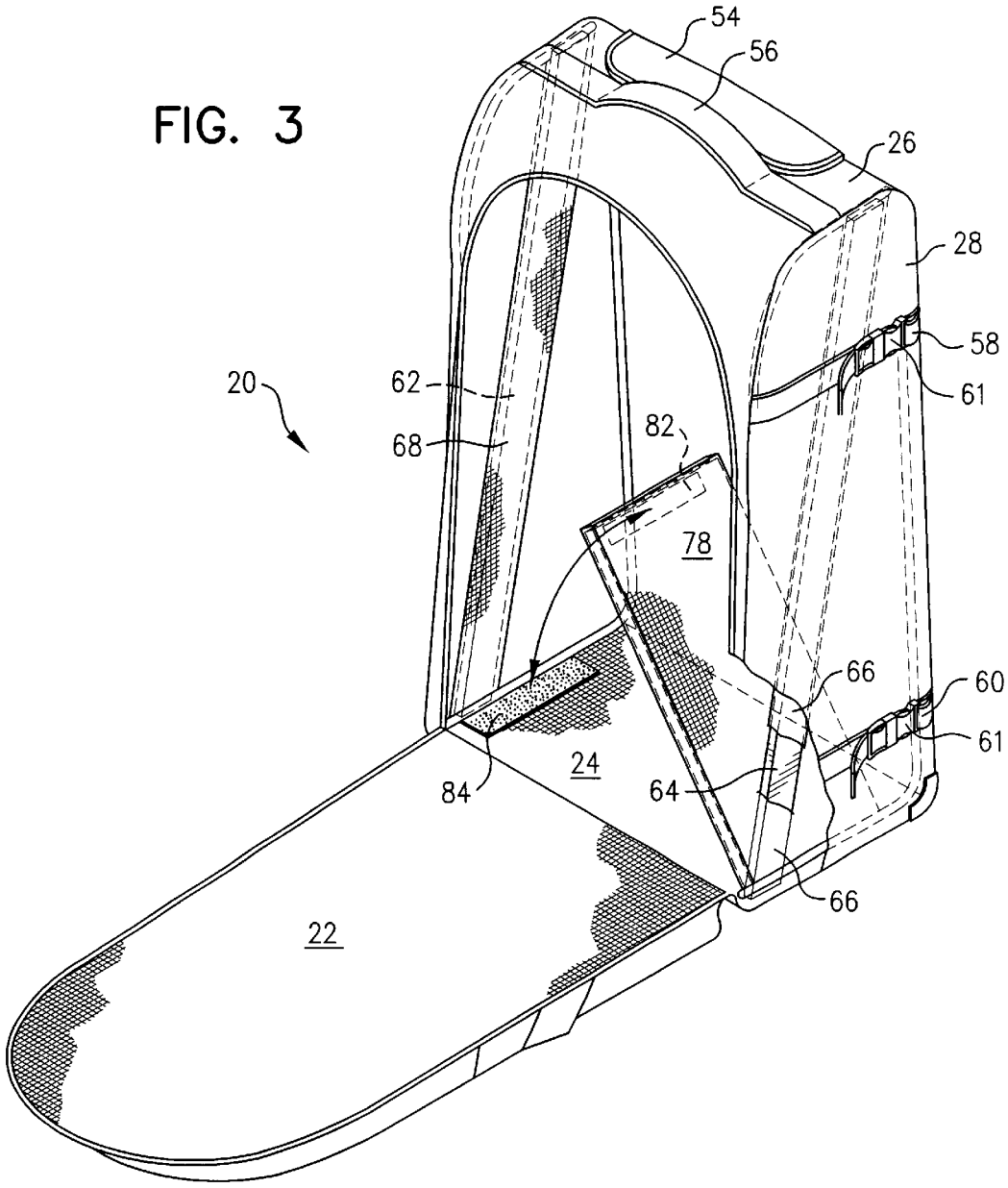
FIG. 3 is top, right perspective view of the wheeled bag of FIG. 1, similar the perspective view of FIG. 1, with a front panel of the wheeled bag opened, and a hinged panel shown as being removed from the bottom panel of the wheeled bag.

As can be seen in FIG. 3, the front panel 22 preferably hinges down and away from the rest of the wheeled bag 20 when the zipper 25 is unzipped. This feature allows convenient access to the inner compartment or compartments of the wheeled bag 20.

The top panel 26 includes a flap 54 that extends over the extendible handle 40 when the extendible handle is retracted. The flap 54 may be closed by hook and loop material or other closing mechanisms, e.g., a zipper. The top panel 26 also includes a handle 56 extending along its top edge. The handle 56 permits a user to carry the wheeled bag 20 while the extendible handle 40 is in a retracted position. The handle 56 may be formed of webbing or any other suitable material.

The right and left side panels 28, 30 include upper and lower cinching straps 58, 60. The cinching straps 58, 60 may be loosened so that a coat or other item may be hung in one or more of the straps. As is further described below, the cinching straps 58, 60 are also used to hold the wheeled bag 20 in the stored configuration. The cinching straps include buckles 61 (e.g., plastic, male/female snap-in buckles). The buckles 61 for the cinching straps 58, 60 on the right side of the wheeled bag 20 are located adjacent the back panel 32, with the female connector closest to the back panel. The buckles on the cinching straps 58, 60 on the left side of the wheeled bag 20 are located adjacent the front of the wheeled bag, with the female connector closest to the front of the bag. The function of this arrangement is described below.

The right and left side panels 28, 30 include reinforcements, for example in the form of metal stays 62, 64. As further described below, the reinforcements aid in holding the side panels 28, 30 in an outward position when the wheeled bag 20 is in the extended configuration. The respective metal stay 62, 64 for each of the side panels 28, 30, extends from an upper, back corner of the respective panel to the lower, front corner of the panel. The metal stay 62, 64 preferably extends to adjacent to these corners, so as to provide the maximum support for the panels. The metal stays 62, 64 are preferably encased within the fabric or other material-that forms the side panels 28, 30. If desired, the metal stays 62, 64 may be encased in webbing 66, 68 (FIG. 3) or another material so as to reduce the chance that the stays might penetrate the panels.

The wheeled bag 20 includes a hinged, semi-rigid panel 78 (FIG. 3) attached along one edge to the bottom, inside edge of the right side panel 28. The hinged panel 78 is rotatable about its connection so that it may align against the right side panel 28, and may hinge downward to extend against the inside surface of the bottom panel 24. Hook and loop fasteners 82, 84 may be provided to hold the hinged panel into position against the bottom panel 24.

The metal stays 62, 64, the hinged panel 78, and the semi-rigid structure 34 of the back panel 32 work together to hold open the wheeled bag 20 when the wheeled bag is in the expanded configuration, permitting easy access to and packing of the inside compartments of the bag. In addition, these structural components permit the wheeled bag 20 to stand on its own when in the expanded configuration. In summary, the hinged panel 78 provides support and structure for the bottom panel 24. The semi-rigid structure 34 of the back panel 32 provides support for the back of the wheeled bag 20, helping to maintain the back of the wheeled bag in a substantially upright position. The metal stays 62, 64 bias the side panels into an upright position and help to keep the top panel 26 from collapsing.

The semi-rigid structure 34 of the back panel 32 provides the anchor of the support for the wheeled bag 20. The stays 62, 64 and the hinged panel immobilize the side and bottom panels using the stationary semi-rigid structure 34 of the back panel 32.

The hinged panel 78 essentially locks the position of the bottom panel. To this end, the hinged panel 78 prevents lateral movement of the bottom panel 24 through its hinged relationship with the right side panel 28, connection via the hook and loop connectors 82, 84, and the rigidity of the hinged panel. Preferably, to minimize lateral movement of the bottom panel 24, the hinged panel 78 abuts against the front edge of the back panel 32, and the hinged panel 78 is of sufficient length to abut against the left side panel 30 of the wheeled bag 20. Thus, by connecting the hinged panel 78 to the bottom panel 24 via the hook and loop connectors 82, 84, the bottom panel is supported and held in position. This feature not only aids in holding the panels opened when the wheeled bag 20 is in the extended configuration, but also permits the wheeled bag to rest against the bottom panel 24 when the wheeled bag 20 is in the extended configuration, without the bottom panel collapsing.

As described above, the stays 62, 64 preferably extend to adjacent the front, bottom edges of the side panels 28, 30. With the semi-rigid structure 34 supporting the back panel 32 and the hinged panel 78 supporting the bottom panel 24, the stays 62, 64 lend diagonal support for the side panels 28, 30. The diagonal support provided by the stays 62, 64 helps to maintain the side panels outward, and align the side panels with the outer edges of the back and bottom panels, when the wheeled bag 20 is in the extended configuration. The stays also support the locked position of the bottom panel 24 and hinged panel 78 by limiting upward or downward movement of the front edge of the two panels. Upward or downward movement of the rear edge of the two panels is limited by the connection of the bottom panel 24 to the back panel 32, and the rigidity of the hinged panel 78.

The stays 62, 64 provide lateral support for the side panels 28, 30, which places the top panel 26 in slight tension, preventing collapse of the top panel 26 when the wheeled bag 20 is in the extended configuration. To aid in preventing collapse, the side panels 28, 30 are tapered in their length. This feature permits the top panel to have a narrow dimension, assuring that the front (unsupported) section of the top panel 26 is not spaced too far from the stays 62, 64.

In addition, the stays 62, 64, along with the structural support 34 of the back panel 32, provide a triangular support that separately, and together with the bottom panel 24, provide support for standing of the wheeled bag. That is, the base of the triangle is formed at the lower edge of each of the side panels 28, 30, and the apex is formed at the juncture of the respective stay 62, 64 and the back panel 32. The weight of the material forward of the back panel is sufficient to bias the wheeled bag 20 forward, so that the lower portion of the triangles formed by the stays 62, 64 and the back panel serves as a sufficient base to prevent tipping of the wheeled bag. The bottom panel 24, reinforced by the hinged panel 78, causes the base to be more substantial, further preventing tipping of the wheeled bag.

Thus, the hinged panel 78, the stays 62, 64, and the structural support 34 provide a framework that supports the wheeled bag 20 in the extended configuration. The support not only holds open the side, top, and bottom panels 28, 30, 26, and 24, but also permits the wheeled bag 20 to stand on its own (i.e., on the bottom panel and the wheels 38). It can be understood that the support provided by the hinged panel 78, the stays 62, 64, and the structural support 34 is dependent upon the material used for these components. That is, the more rigid the components, the more structure the components provide. However, applicant has found that a semi-rigid material is sufficient to provide the features of the structural support 34. By not using rigid materials for this component, the wheeled bag is less stiff, and the overall weight of the wheeled bag is less. In addition, the handle receptacle 36 and the skid plates 42, 44 aid in stiffening and supporting the structural support 34. However, as used herein, the use of "semi-rigid," to describe the structural support 34 is meant to cover materials that are either semi-rigid or rigid.

Applicants have also found that a semi-rigid material is sufficient for the hinged panel 78. Likewise, as used herein, the use of "semi-rigid," to describe the hinged panel 78 is meant to cover materials that are either semirigid or rigid.

Because the stays 62, 64 are thin and relatively lengthy, it is preferred that the stays be made of a more rigid material, such as steel, fiberglass rods, or aluminum. However, the stays 62, 64 may also be made of a semi-rigid material.

As stated above, the front, side, bottom, and top panels are preferably formed of a soft material, such as canvas or another fabric. The soft material aids in folding of the bag, and permits the wheeled bag to be lightweight. Prior art wheeled luggage did not utilize soft panels because soft materials do not provide the structure necessary for a wheeled bag to stand on its own and for the wheeled bag to remain open so that a user may have unimpeded access to the internal compartments of the wheeled bag. In accordance with one aspect of the present invention, one or more of the front, side, bottom, and top panels, or part of those panels, may not be soft. For example, the side panels may be made of a semi-rigid material that incorporates the features of the metal stays 62, 64 and the side panels. If such side panels are utilized, it is preferred that they be constructed so that the side panels may be folded into the center in the stored configuration, for example by hinging the side panels to the back panel.

The folding process for the wheeled bag 20 is shown in FIGS. 3–6. First, while the front panel 22 is zipped out, the hook and loop connecters 82, 84 for the hinged panel 78 are released, and the hinged panel is folded upward against the right side panel 28. The beginning of the folding process for the hinged panel 78 is shown in FIG. 3, and the hinged panel is shown (in phantom) against the right side panel in FIG. 4. The front panel 22 is then preferably zipped closed, although closure is not necessary for folding the wheeled bag 20 into the stored configuration.

Figure 5:
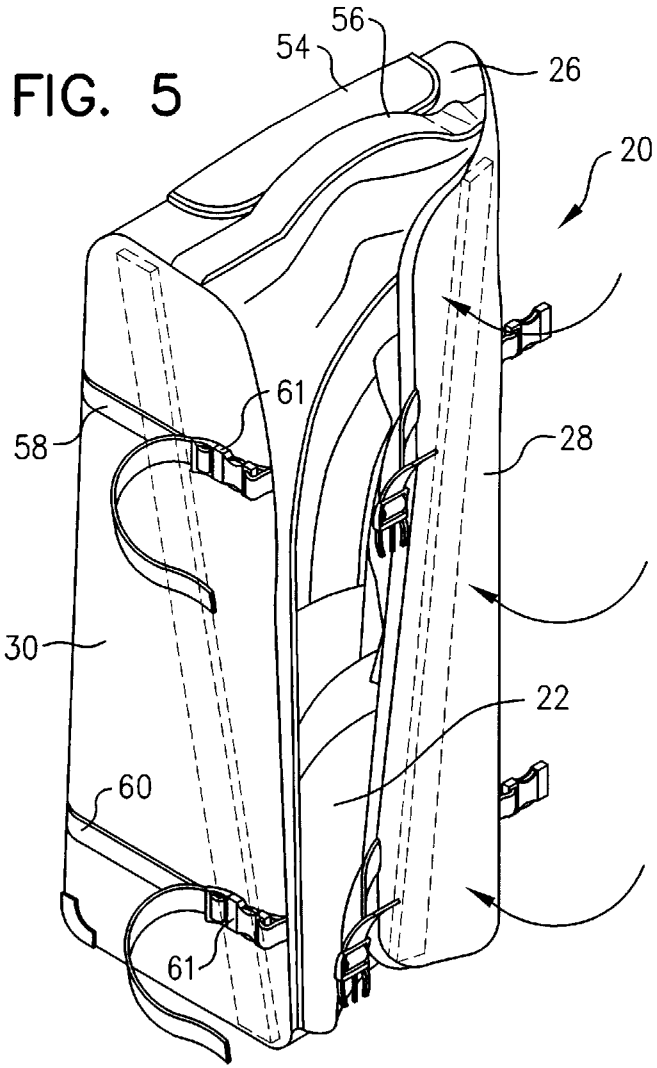
FIG. 5 shows a further stage of folding of the wheeled bag of FIG. 1.
Figure 4:
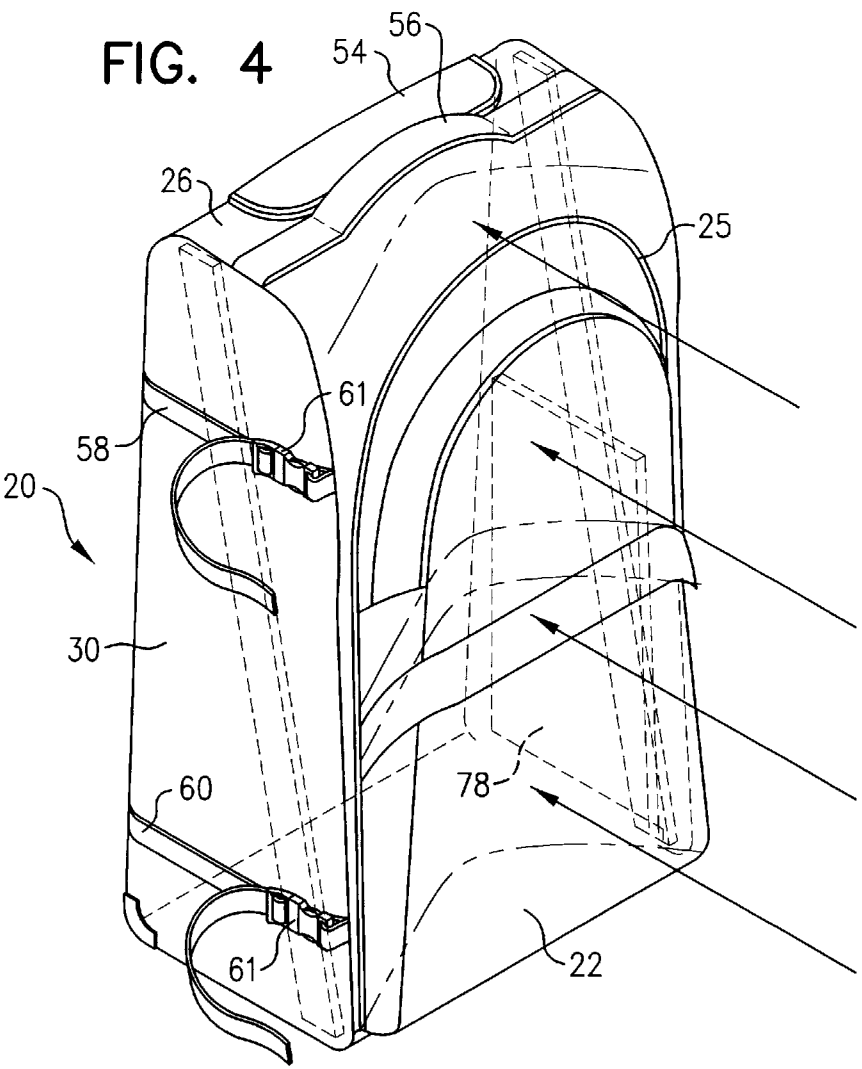
FIG. 4 shows a beginning stage of folding of the wheeled bag of FIG. 1.

The center portion of the front panel 22 is then pressed forward (FIG. 4), and the right side panel 28 and left side panel 30 are folded against the front of the front panel (FIGS. 5 and 6). The buckles 61 for the cinching straps 58, 609 are released, and the male portions of the buckles on the left side of the wheeled bag are slid along their respective straps (i.e., adjusted to the proper length), and are inserted into the female portion of the buckles on the right side (FIG. 6). Pulling down on the loose ends of the straps may then tighten the fastened buckles.

It can be understood that the wheeled bag 20 may be held in the stored configuration in a variety of different ways other than the arrangement of the cinch straps 58, 60 described herein. In addition to changing the location or number of the cinch straps 58, 60, different closures may be used, including, but not limited to, snaps, drawstrings, hooks, hook and loop fasteners, clips, and bungee cords. In addition, a closure for the wheeled bag 20 may not be provided, in which case the user may fold the wheeled bag together and place the folded wheeled bag into a container such as a knapsack.

Alternative embodiments of the wheeled bag 20 are contemplated. For example, the hinged panel 78 may fold down from the left side of the wheeled bag, or even from the back. In addition, reinforcements (e.g., metal stays) for the side panels 28, 30 may be provided that are configured to extend through substantially all of the side panels, instead of a diagonal strip of the panels. However, the hinged panel 78, the stays 62, 64, and the structural support 34 are preferably arranged so that they minimally impede folding of the side panels into the stored configuration, yet provide sufficient support so that the wheeled bag may stand on its own and the panels may be held outward when the wheeled bag is in the stored configuration.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims. For example, while the embodiment of the wheeled bag 20 shown in the drawings is generally box-shaped, the concepts of the present invention may be utilized in a bag having many different configurations. For example, the front panel 22 may extend to the upper part of the back panel, effectively eliminating the need for a top panel 26. However, in such an embodiment, the edge formed at the top of the modified wheeled bag may be interpreted as a top panel. Other components may be similarly eliminated, so that the functions of the eliminated components are incorporated into other components.

What is claimed is:

1. A bag comprising:

a soft bottom panel having a front edge spaced from a back edge;

a semirigid back panel attached to the back edge of the soft bottom panel;

first and second side panels attached to the back panel and the bottom panel and foldable toward the back panel;

a front panel attached to at least one of the first and second side panels;

at least one wheel attached to the back panel; and a semi-rigid panel hinged to a bottom edge of the first side panel;

the bag reconfigurable between:

a first configuration where the semi-rigid panel is adjacent the soft bottom panel and extends toward the second side panel; and a second configuration where the semi-rigid panel is spaced from the bottom panel and the first and second side panels are folded toward the back panel.

2. The bag of claim 1, further comprising a locking mechanism for securing the semi-rigid panel in the first configuration.

3. The bag of claim 2, wherein the locking mechanism comprises hook and loop connectors.

4. The bag of claim 1, wherein the first side panel comprises a soft material.

5. The bag of claim 4, wherein the first side panel comprises a reinforcement that, in the first configuration, limits upward and downward movement of the front edge of the soft bottom panel.

6. The bag of claim 4, wherein the first side panel comprises a reinforcement that extends from a front, lower corner of the first side panel to an upper, rear corner of the first side panel.

7. The bag of claim 6, further comprising a top panel attached to the first and second side panels.

8. The bag of claim 7, wherein the front panel comprises a flap attached to the bottom panel and removably attached to the bag, so that when the flap is attached, the front panel is attached to the first and second side panels and the top panel, and is attached to the soft bottom panel.

9. The bag of claim 8, wherein the flap is attachable by a zipper.

10. The bag of claim 7, wherein the front panel and the second side panel each comprise a soft material.

11. The bag of claim 1, further comprising a closure mechanism configured to secure the bag in the second configuration.

12. The bag of claim 11, further comprising a first cinch mechanism having two straps that are attachable to extend across at least a portion of the first side panel, and a second cinch mechanism having two straps that are attachable to extend across at least a portion of the second side panel, at least one of the straps of the first cinch mechanism and at least one strap of the second cinch mechanism being attachable to each other when the bag is in the second configuration, and wherein the closure mechanism comprises the attachment of the at least one strap of the first cinch mechanism and the at least one strap of the second cinch mechanism when the bag is in the second configuration.

13. The bag of claim 12, wherein the two straps of the first cinch mechanism comprise male and female buckles, and the two straps of the second cinch mechanism comprises male and female buckles, and wherein the male buckle of one of the pairs of buckles is attachable to the female buckle of the other pair to secure the bag in the second configuration.

14. The bag of claim 1, further comprising an extendible handle attached to the back panel.

15. A bag comprising:

a soft bottom panel having a front edge spaced from a back edge;

a semi-rigid back panel attached to the back edge of the soft bottom panel;

first and second soft side panels attached to the back panel and the bottom panel;

a first reinforcement extending from a front, lower corner of the first side panel to an upper, rear corner of the side panel;

a soft top panel attached to the back panel and the first and second side panels;

a front panel attached to the soft bottom panel, the first side panel, the second side panel, and the top panel;

a semi-rigid panel hinged to a bottom edge of the first side panel and reconfigurable between:

a first configuration where the semi-rigid panel is adjacent the soft bottom panel; and a second configuration where the semi-rigid panel is spaced from the bottom panel.

16. The bag of claim 5, further comprising at least one wheel attached to the back panel.

17. The bag of claim 15, further comprising an extendible handle attached to the back panel.

18. The bag of claim 15, wherein the semi-rigid panel extends to adjacent the second side panel.

19. The bag of claim 15, wherein the front panel comprises a flap attached to the bottom panel and removably attached to the bag, and wherein the flap is attachable by a zipper.

20. The bag of claim 15, wherein the bag is reconfigurable to a stored configuration where the first and second side panels are folded toward the back panel.

21. The bag of claim 20, further comprising a closure mechanism configured to secure the bag in the stored configuration.

22. The bag of claim 21, further comprising a first cinch mechanism having two straps that are attachable to extend across at least a portion of the first side panel, and a second cinch mechanism having two straps that are attachable to extend across at least a portion of the second side panel, at least one of the straps of the first cinch mechanism and at least one strap of the second cinch mechanism being attachable to each other when the bag is in the stored configuration, and wherein the closure mechanism comprises the attachment of the at least one strap of the first cinch mechanism and the at least one strap of the second cinch mechanism when the bag is in the stored configuration.

23. The bag of claim 22, wherein the two straps of the first cinch mechanism comprise male and female buckles, and the two straps of the second cinch mechanism comprises male and female buckles, and wherein the male buckle of one of the pairs of buckles is attachable to the female buckle of the other pair to secure the bag in the stored configuration.

24. A bag comprising:

a soft bottom panel having a front edge spaced from a back edge;

a semi-rigid back panel attached to the back edge of the soft bottom panel;

fist and second soft side panels attached to the back panel and the bottom panel;

a top panel attached to the back panel and the first and second side panels;

a first stay mounted along the first soft side panel extending from a front, lower corner of the first side panel to an upper, rear corner of the side panel;

a front panel attached to the soft bottom panel, the first side panel, the second side panel, and the top panel;

at least one wheel attached to the back panel and arranged so that the at least one wheel engages a surface upon which the bottom panel is resting; and a semi-rigid panel hinged to the bottom panel so that it may be moved toward and away from the bottom panel;

the bag being configurable between a first configuration where the semi-rigid panel extends along bottom panel and support the bottom panel and the first stay supports the first side panel in an upright position, and second configuration wherein the semi-rigid panel is moved away from the bottom panel and the bottom panel and first side panel, along with the first stay, may fold toward the back panel.

25. The bag of claim 24, further comprising a second stay mounted along the second soft side panel, extending from a front, lower corner of the second side panel to an upper, rear corner of the side panel, the second stay supporting the second side panel in the first configuration and folding with the second side panel toward the back panel in the second configuration.

26. A bag comprising:

a soft bottom panel having a front edge spaced from a back edge;

a semi-rigid back panel attached to the back edge of the soft bottom panel;

first and second soft side panels attached to the back panel and the bottom panel;

a top panel attached to the back panel and the first and second side panels;

a first reinforcement in the first soft side panel, extending from a front, lower corner of the first side panel to an upper, rear corner of the side panel;

a second reinforcement in the second soft side panel, extending from a front, lower corner of the second side panel to an upper, rear corner of the side panel;

a front panel attached to the soft bottom panel, the first side panel, the second side panel, and the top panel;

at least one wheel attached to the back panel and arranged so that the at least one wheel engages a surface upon which the bottom panel is resting; and a semi-rigid panel hinged to a bottom edge of the first side panel so that it may be moved toward and away from the bottom panel.

27. The bag of claim 26, wherein the bag comprises two wheels attached to the back panel.

28. The bag of claim 26, further comprising an extendible handle attached to the back panel.

29. The bag of claim 26, further comprising a locking mechanism for securing the semi-rigid panel against the bottom panel.

30. The bag of claim 29, wherein the locking mechanism comprises hook and loop connectors.

31. The bag of claim 26, wherein the front panel comprises a flap attached to the bottom panel and removably attached to the bag, and wherein the flap is attachable by a zipper.

32. The bag of claim 26, wherein the bag reconfigurable to a stored configuration where the first and second side panels are folded toward the back panel.

33. The bag of claim 32, further comprising a closure mechanism configured to secure the bag in the stored configuration.

34. The bag of claim 33, further comprising a first cinch mechanism having two straps that are attachable to extend across at least a portion of the first side panel, and a second cinch mechanism having two straps that are attachable to extend across at least a portion of the second side panel, at least one of the straps of the first cinch mechanism and at least one strap of the second cinch mechanism being attachable to each other when the bag is in the stored configuration, and wherein the closure mechanism comprises the attachment of the at least one strap of the first cinch mechanism and the at least one strap of the second cinch mechanism when the bag is in the stored configuration.

35. The bag of claim 34, wherein the two straps of the first cinch mechanism comprise male and female buckles, and the two straps of the second cinch mechanism comprises male and female buckles, and wherein the male buckle of one of the pairs of buckles is attachable to the female buckle of the other pair to secure the bag in the stored configuration.

36. The bag of claim 26, wherein the semi-rigid panel extends to adjacent the second side panel.

37. A bag comprising:

a soft bottom panel having a font edge spaced from a back edge;

a semi-rigid back panel attached to the back edge of the soft bottom panel;

first and second soft side panels attached to the back panel and the bottom panel;

a top panel attached to the back panel and the first and second side panels;

a front panel attached to the soft bottom panel, the first side panel, the second side panel, and the top panel;

at least one wheel attached to the semi-rigid back panel;

a reinforcing structure that is configurable between a first configuration in which the reinforcing structure supports the bag in an expanded position in which the bag is supportable upon the at least one wheel and the bottom panel, and a second configuration in which the bag is foldable to a compact arrangement;

a first cinch mechanism having two straps that are attachable to extend across at least a portion of the first side panel; and a second cinch mechanism having two straps that are attachable to extend across at least a portion of the second side panel, at least one of the straps of the first cinch mechanism and at least one strap of the second cinch mechanism being attachable to each other when the bag is in the second configuration so as to store the bag in the second configuration.

38. The bag of claim 37, wherein the two straps of the first cinch mechanism comprise male and female buckles, and the two straps of the second cinch mechanism comprises male and female buckles, and wherein the male buckle of one of the pairs of buckles is attachable to the female buckle of the other pair to secure the bag in the second configuration.

* * * * *